United States Patent [19]

Judd

[11] 4,133,993

[45] Jan. 9, 1979

[54] MOMENTARY CONTACT SWITCH WITH COMPENSATING SPRING

[75] Inventor: Edwin B. Judd, East Greenwich, R.I.

[73] Assignee: General Electric Company, New York, N.Y.

[21] Appl. No.: 819,930

[22] Filed: Jul. 28, 1977

[51] Int. Cl.[2] ..... H01H 3/00; H01H 21/04

[52] U.S. Cl. ..... 200/153 K; 200/67 DA

[58] Field of Search ..... 200/6 BB, 6 C, 67 R, 200/67 A, 67 D, 67 DA, 68, 153 H, 153 K, 153 L, 153 LA, 154, 293

[56] References Cited

U.S. PATENT DOCUMENTS

| | | | |
|---|---|---|---|
| 2,725,438 | 11/1955 | Bentley | 200/67 A |
| 2,759,075 | 8/1956 | Hults | 200/153 K |
| 2,808,490 | 10/1957 | Case et al. | 200/67R |
| 2,961,519 | 11/1960 | Sadowsky et al. | 200/68 X |
| 3,082,303 | 3/1963 | Wiley | 200/67 D |
| 3,178,522 | 4/1965 | Passarelli, Jr. | 200/67 DA |
| 3,204,071 | 8/1965 | Passarelli, Jr. et al. | 200/153 K |
| 3,320,389 | 5/1967 | Arlauskas | 200/153 K |
| 3,408,463 | 10/1968 | Wanlass | 200/153 K |
| 3,410,971 | 11/1968 | Sandor | 200/153 L |
| 3,519,775 | 7/1970 | Weremey | 200/153 K |

*Primary Examiner*—Steven E. Lipman
*Assistant Examiner*—Steven M. Pollard
*Attorney, Agent, or Firm*—Paul E. Rochford; F. L. Neuhauser

[57] ABSTRACT

A momentary contact switch is provided having a toggle actuator with the toggle in a normal center-off position. Two different momentary contacts are achieved by pivoting the toggle in either of two directions from its center-off position to one of two ON positions. The toggle returns to the center-off position by spring bias. The spring bias is essentially equal for either ON position and is achieved with a minimum number of parts for such even bias.

5 Claims, 11 Drawing Figures

MOMENTARY CONTACT SWITCH WITH COMPENSATING SPRING

BACKGROUND OF THE INVENTION

The present invention relates to a three-position momentary contact switch with a center-off position of an actuating toggle. The actuating toggle has two ON positions as it is pivoted away from its center-off position in either direction.

Such momentary contact switches have been known in the past. However, the prior art switches have been characterized largely by a non-symmetrical array of forces which must be applied either in turning the switch on or tending to return the switch to its center-off position.

BRIEF DESCRIPTION OF THE FIGURES

In the description which follows, a better understanding of the invention will be gained by reference to the accompanying drawings, in which.

OBJECTS OF THE INVENTION

It is one object of the present invention to provide at relatively low cost a three-position center-off momentary contact switch which has a very equal balance of pressures required to operate the switch trigger in either direction.

Another object of the invention is to provide a three-position center-off momentary contact switch which has a relatively small number of parts but which is very effective nonetheless in performing its switching function.

Another object is to provide a switch mechanism as above which is relatively low in cost both because of the relatively smaller number of component parts, and because of the ease of assembly of these parts, although a highly reliable operating efficiency is gained.

Other objects will be in part apparent and in part pointed out in the description which follows.

In carrying out broader objects of the invention, a switch is provided having an insulating housing made up of a body and a cover with a strap extending from the ends of the cover to permit mounting the switch in a wall box. A toggle mechanism is included in the housing with a trigger of the toggle extending through and from the cover to permit manual manipulation of the toggle. Internally, the switch has electrically conducting parts which extend from the switch through screw terminals mounted in walls of the body. Two electrical parts are stationary and the third is movable and in the form of a leaf spring to complete an electrical path with either of the two stationary parts. The under surface of the toggle is provided with a cam which selectively actuates the movable electrical part into and out of electrical contact with the stationary parts. A second leaf spring mounted in the switch body and having the general form of the letter "C" contacts another surface on the underside of the toggle and counter balances the spring bias on the toggle to give the toggle a stable center position in which the third electrical part does not contact either stationary part. Also the springs are balanced so that movement of the trigger in either clockwise or counterclockwise direction is against about equal spring bias and results at each end of the trigger stroke in contact with one of the other of the stationary contacts. The "C" leaf spring is pre-loaded by being partially compressed by having the cover engage and press down on the arm of the "C" spring as the switch is assembled.

DESCRIPTION OF THE PREFERRED EMBODIMENT

Figure 1:
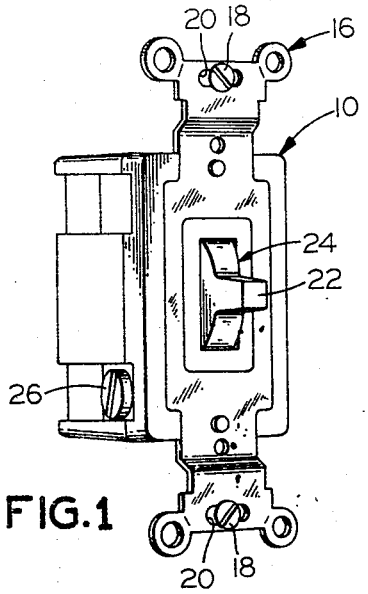
FIG. 1 is a perspective view of the exterior of the switch of this invention with the toggle trigger shown in its center-off position.

The switch of the present invention, like many electrical switches, has an insulating housing 10 made up of an insulating cover 12 and an insulating body 14. The switch also has a mounting strap 16 held to the insulating body 10 and provided with mounting screws 18 within the screw slots 20 at the respective ends of the strap. A trigger 22 extending from a toggle 24 controls the movement of electrical parts within the insulating housing 10. Three external screw terminals 26, 28 and 30 used for attachment of wire conductors for supply of electric power through and from the switch appear in FIGS. 1, 2 and 3.

Figure 3:
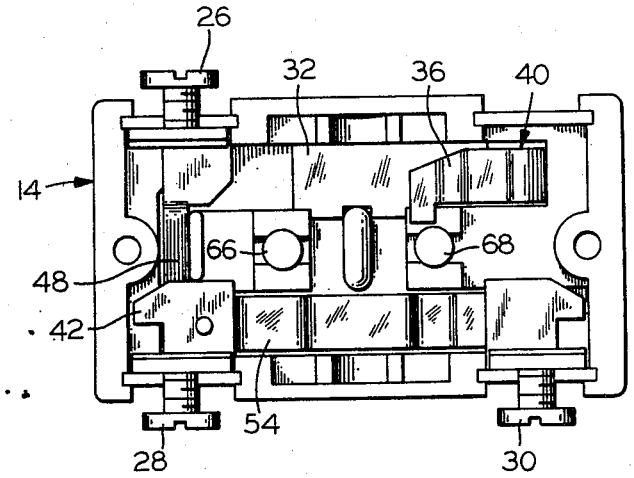
FIG. 3 is a top plan view of the switch of FIG. 1 with the cover toggle and strap removed.

FIG. 3 illustrates the interior of the body 14 of the switch and the various elements within the body on which the toggle mechanism operates. The toggle itself is not operated through a coil type of overcenter spring extending from a boss in the bottom of the body and a corresponding boss at the lower center of the trigger as is conventional in many switches of the prior art. Rather, the centering action on the toggle mechanism is achieved through a combination of the movable contact arm itself taken together with a leaf spring in the general configuration of a "C". The C spring 40 is positioned on one side of the switch body and extends partially along its length. It has a base 32, an upright 34 and an upper yieldable surface 36. The upper surface 36 is positioned for contact with a beveled surface 64 of toggle 24, as seen in FIGS. 4 through 7.

Figure 4:
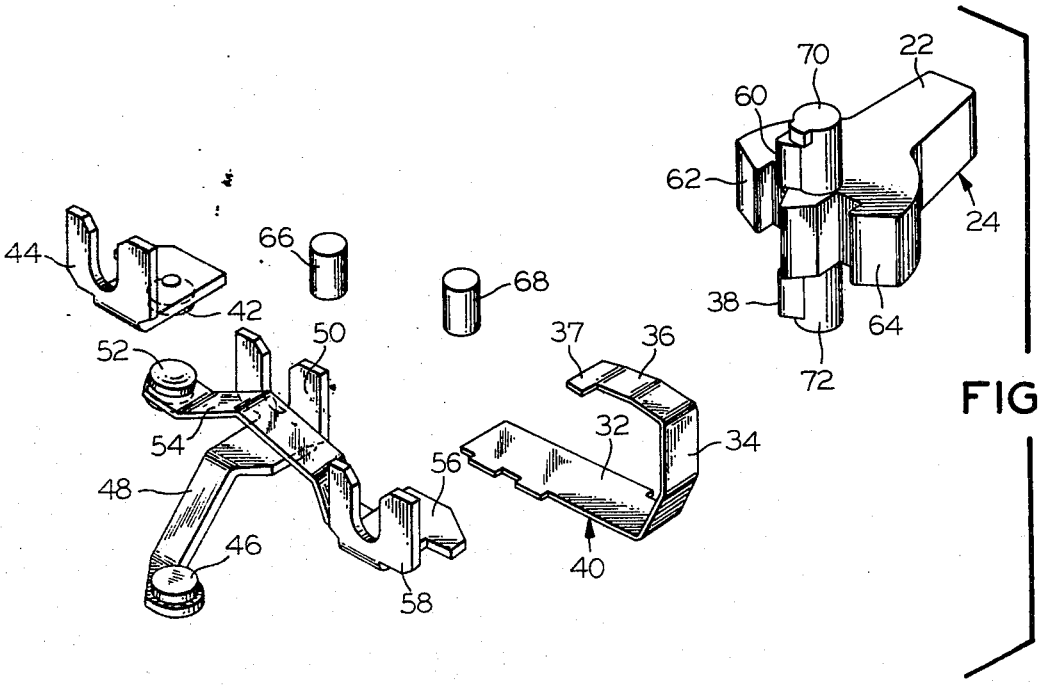
FIG. 4 is an exploded view of electrical parts of the switch interior in relation to the toggle.

Referring to FIG. 4, this figure illustrates the internal metal parts of the switch in exploded form and shows the toggle displaced through an arc from its normal upright position above and in contact with some of these metal parts to a position in which the toggle appears to lie on its side to the right of these elements. The displacement of toggle 24 through such arc permits the bottom surfaces of the toggle to be viewed. It also permits the interrelation between these bottom surfaces and metal parts within the housing to be better understood.

Figure 2:
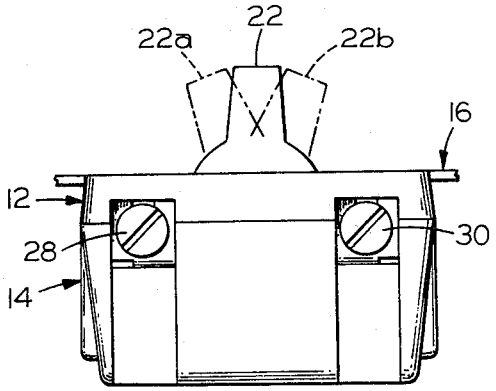
FIG. 2 is a side elevation of the switch of FIG. 1 showing multiple possible trigger positions.

The toggle has two contact positions and these contact positions are at the two end positions to which the toggle can be pivoted through movement of its trigger as illustrated in FIG. 2. The center-off position of the trigger is the center solid line position and the two ON positions are to the right and left. The toggle is illustrated in its left position 22*a* and in its right position 22*b* in FIG. 5. Actually the normal position of the trigger is the center position and it is in this position that the switch is OFF and no contact is made between electrical elements within the switch interior. The switching elements themselves, as illustrated in FIGS. 3 and 4, include a stationary contact 42 formed integrally with the upstanding screw terminal harness 44 adapted to receive the terminal screw 28. A second stationary contact 46 is located at the end of arm 48 and the arm 48 is formed integrally with the harness 50 which is adapted to receive screw terminal 26.

A movable double contact 52 is located at the end of movable arm 54 and movable arm 54 is attached to the strip 56 formed integrally with the harness 58 adapted to receive the screw terminal 30. Cam 60 on toggle 24 contacts the spring arm 54 when the trigger 22 is either in its center-off position or when it is pivoted to position 22*a* as illustrated in FIG. 2.

The toggle 24 also has the beveled surfaces 62 and 64 which impact against the bumpers 66 and 68 respectively to impart a cushioned stop at the end of the trigger stroke of the trigger 22.

Figure 5:
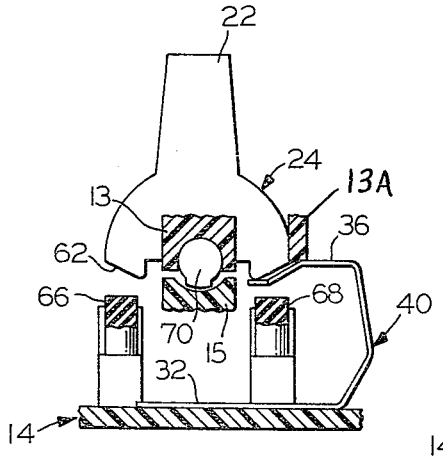
FIG. 5 is a side elevation in part in section of parts of a switch housing and components within the housing.

Trunions 70 and 72 hold the toggle 24 in position in the housing 10 between the housing cover 12 and housing body 14. This holding of the toggle in place is illustrated in FIG. 5 wherein it is seen that trunion 70 is held between a portion 13 of the cover 12 and a portion 15 of the body 14. In FIG. 5, the alignment of the beveled surface 62 above the bumper 66 is also evident. Further, the C spring 40 is seen to make contact at the tip 37 with the beveled surface 64 of toggle 24. This same surface 64 of toggle 24 impacts on bumper 68 to cushion the end of the stroke of trigger 22 as it pivots to the right.

Figure 6:
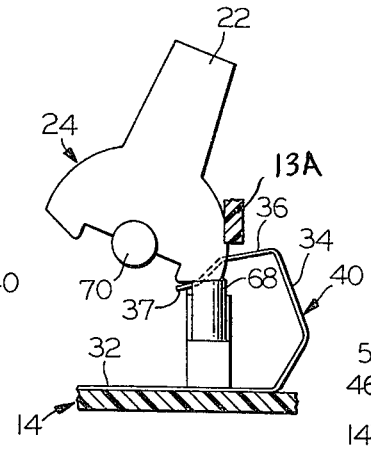
FIG. 6 is a view similar to that of FIG. 5 in which a toggle mechanism is shown tilted in one direction.
Figure 8:
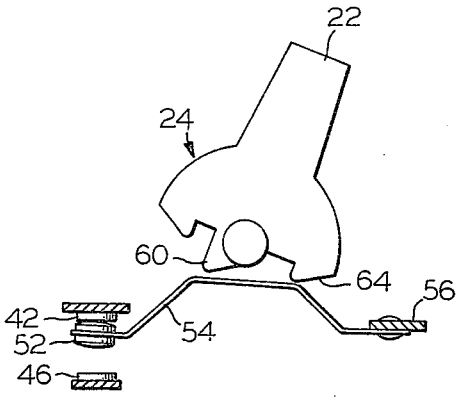
FIG. 8 is a view similar to that of FIG. 5 but in which the movement of the toggle is shown to permit a contact arm to make contact with one of the two stationary contacts.

At the same time that the trigger 22 moves to the right hand position, as seen in FIG. 6, the cam 60 releases its contact with the spring arm 54 and allows the arm to move up so that the double contact 52 is in electrical contact with the stationary contact 42, as evident in FIG. 8. Stationary contact 46 below the movable and stationary contacts 52 and 42 respectively, is accordingly not included in the electrical connections existing within the switch when the toggle 22 is in the right hand position.

Figure 7:
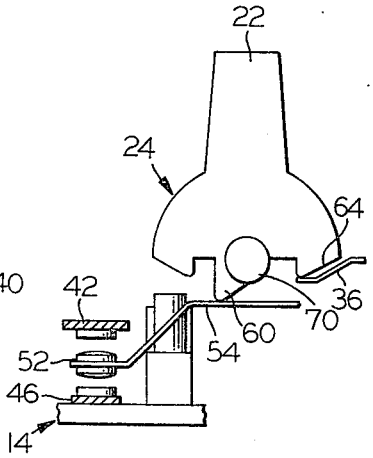
FIG. 7 is a view similar to that of FIG. 5 in which stationary contacts within a housing are shown in relation to movable contacts in the housing.

In FIG. 7, the neutral position of double contact 52 is illustrated. Double contact 52 is positioned between upper stationary contact 42 and the lower stationary contact 46 and this positioning is controlled by the pressure exerted by the cam 60 on conducting arm 54. At this point, there is a balance between the pressure exerted by the cam 60 of toggle 24 on arm 54 at the left, and the pressure exerted by the "C" spring arm 36 on beveled surface 64 of toggle 24 on the right.

Referring again to FIGS. 5 and 6, in these figures the relationship between the C spring 40 and the toggle 24 is illustrated. The toggle is shown in two positions. The toggle in FIG. 5 is in the center position and in FIG. 6 is in a position tilted toward the right. In both positions, toggle 24 interacts with the C spring 40. In both FIGS. 5 and 6, the cams on the toggle are not shown and the interaction of the cam 60 with the spring arm 54 is not shown. "C" spring 40 is in a pre-loaded condition and this pre-loading is the result of having a portion 13A of cover 12 contact the arm 36 of "C" spring 40 to partially compress the "C" spring during the assembly of the switch.

Figure 9:
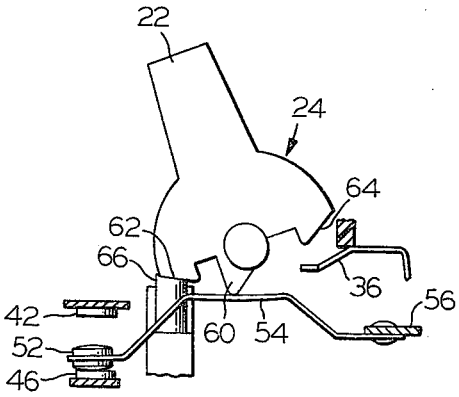
FIG. 9 is a view similar to that of FIG. 8 in which the toggle mechanism is pivoted in its opposite ON position and in which the second of the stationary contacts is contacted by the movable contact at the end of a contact arm.

In FIGS. 8 and 9, the cam 60 and spring arm 54 are shown and the C spring is not shown or not fully shown. In FIG. 7, the arm 36 of the C spring 40 which contacts toggle 24 and also the cam 60 which contacts spring arm 54 are shown. Accordingly, these five figures show the interrelationship between the toggle and the springs with which it interacts.

Turning now particularly to discussion of FIGS. 8 and 9, the toggle in FIG. 8 is shown in its tilted right position (with the trigger tilted to the right) and in FIG. 9 the trigger 22 is tilted to the left. As previously stated, when the toggle is in the position illustrated in FIG. 8, the cam 60 is out of contact with the spring arm 54 and the spring arm raises the double contact 52 into electrical contact with the upper stationary contact 42. By contrast in FIG. 9, with the trigger tilted to the left, the cam 60 of toggle 24 depresses the arm 54 and brings the double contact 52 into electrical contact with the lower stationary contact 46. At this point, the beveled surface 62 of toggle 24 is depressed into cushioning bumper contact with bumper 66 to limit and cushion the extent of movement of the trigger to the left.

Figure 10:
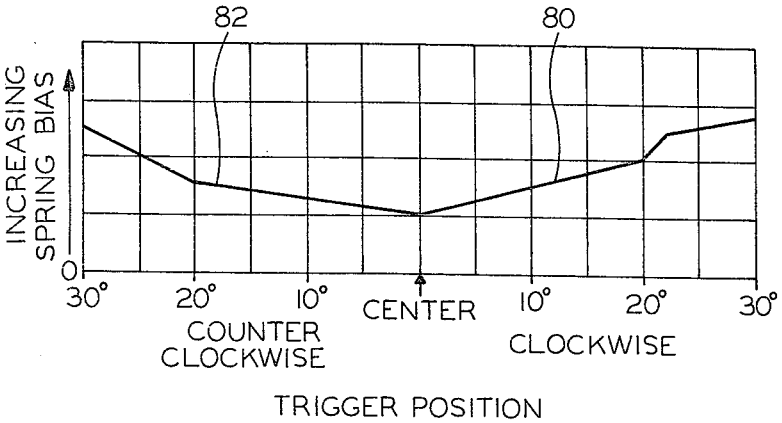
FIG. 10 is a plot of the pressure applied on the toggle mechanism by springs within the switch housing in relation to the toggle angular position as the trigger is moved both in a clockwise and in a counterclockwise direction.

Turning now to FIG. 10, a graph illustrates the spring force acting on the toggle plotted vertically in relation to the position of the trigger plotted longitudinally. The graph illustrates certain advantages of the mechanism of the present invention and particularly the evenly increasing pressure which is applied to the toggle as it moves from its center-off position (FIGS. 5 and 7) to either of the on positions illustrated in FIGS. 8 and 9. In this graph, the position of the trigger and its displacement in degrees from the center-off position of FIGS. 5 and 7 is illustrated on the horizontal base line of the graph. As indicated, the center position of the graph where lines 80 and 82 meet is that illustrated in FIGS. 5 and 7.

In contrast to the balanced pressures operating on the toggle in the center-off position, when the trigger is moved in a counter-clockwise direction, as illustrated in FIG. 9, the force tending to return the trigger to its center-off position is increased as the angle of rotation about the cam 70 is increased and the plot of this force is illustrated at line 82 of FIG. 10.

As the trigger 22 is moved clockwise as illustrated in FIGS. 6 and 9, the force acting on the toggle tending to return it to the center-off position increases as illustrated by the line 80 of FIG. 10.

In other words, as the trigger 22 is moved either in a clockwise or counterclockwise direction, the force acting on the toggle to return the trigger to its center-off position increases as the angle of rotation about the toggle trunion 70 is increased whether the direction is clockwise or counterclockwise.

Figure 11:
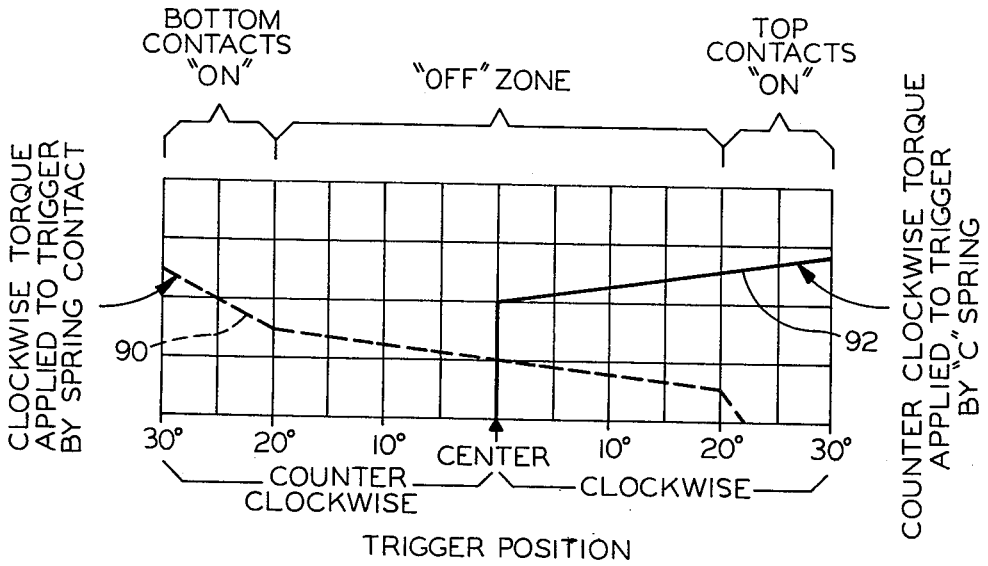
FIG. 11 is a graph showing the relationship between the trigger position and the torque applied to the trigger by springs in contact with the toggle.

In FIG. 11, an illustration is plotted of the individual forces of the spring members of the switch acting on the toggle 24. The dashed line 90 illustrates the relationship between the force applied to the cam 60 by the spring arm 54 and the angle through which the trigger 22 of toggle 24 is turned.

As is evident from FIG. 11, the only force acting on the toggle as it moves in a counterclockwise direction is the spring force of spring arm 54 acting on cam 60 and illustrated by the part of dashed line 90 to the left of the center-off position of FIG. 11. When the toggle is at rest, there is a combination of the forces applied by the spring arm on cam 60 of the toggle illustrated by line 90 taken together with the force applied by the C spring 40 on the toggle 24 at the beveled surface 64 illustrated by line 92. The force of the C spring acting on toggle 24 at surface 64 is illustrated in FIG. 11 at line 92. As pointed out above the "C" spring 40 is pre-loaded by virtue of the portion 13A of cover 12 pressing down on arm 36 of "C" spring 40. This pre-loading is evidenced by the vertical portion of line 92 at the center of the plot of FIG. 11. In other words the pressure applied by surface 64 starts at the value indicated by the upper end of the vertical portion of line 92. Because the force imparted to the toggle by the C spring is opposite to that imparted to the toggle by the spring contact arm, these forces balance each other in the at rest center position, as illustrated in FIG. 10 by the intersection of line 80 and line 82.

The line 80 of FIG. 10 represents the result of the combination of oppositely acting forces on the toggle as the toggle 24 is at its at-rest center position and as it is moved in a clockwise direction from the center at-rest position. The oppositely acting forces are illustrated in FIG. 11 by the separate plots of these forces illustrated by line 90 for the forces imparted by the spring arm 54 and the line 92 for the forces imparted by the C spring 40.

Legends on the top of the plot of FIG. 11 describe the results of the interaction of the spring forces in terms of the switch operation. Thus, at the top of the plot, it is evident that the switch is OFF in a zone extending from an approximate 20° counterclockwise rotation of the toggle 24 about its trunion 70 to a position of approximately 20° clockwise rotation of the toggle. Beyond approximately 20° clockwise rotation, the top contact connecting with screw terminal 28 is ON so that screw terminal 28 and 30 are connected.

In a trigger position of rotation beyond approximately 20° counterclockwise, the double contact 52 is in electrical contact with the stationary contact 46 so that the screw terminals 28 and 26 are electrically connected.

As used herein the term first spring refers to a spring element which is auxilliary to the electrical operation of the switch in that it acts on the toggle but it does not carry current. Similarly, the term second spring refers to a leaf spring element which, in addition to exerting spring pressure on the toggle, can carry current along and through the length thereof from one screw terminal and associated contacts to another.

While the first spring or "C" spring referred to herein is shown to have the general form of the letter C with the base of the C in the bottom of the insulating body 14, it will be understood that the first spring employed can be any spring mounted in the body 14 and pre-loaded as described above by developing spring bias on the first spring as the cover 12 is assembled to body 14. The action of toggle 24 must be to increase the spring bias on the first spring to a value above the spring bias imparted to the first spring in assembly of the switch housing.

What is claimed and sought to be protected by Letters Patent of the United States is:

1. A two position center-off momentary contact switch which comprises, an insulated housing including a base and cover;

three electrical terminals extending through insulating walls of said housing;

a toggle mechanism in said housing having a toggle trigger extending through the cover of said housing;

two spring members in said housing disposed to exert spring bias against portions of said toggle within said housing;

the combined spring bias of said spring members being minimum at the center-off, at rest, position of said toggle;

said two spring members comprising a first spring supported at a fixed end thereof being pre-loaded by bearing against an internal surface of the cover, said first spring contacting the undersurface of the toggle on the at-rest position and all positions clockwise of said at-rest position, and a second spring supported at a fixed end in the base of the insulating housing and bearing upward against an internal surface of said toggle, said second spring being a conductive cantilevered leaf spring which is supported at its fixed end from a conductive element electrically connected to a first of the three electrical terminals, electrical contacts proximate the free end of said second spring for alternate contact with an electrical contact electrically connected to a second of said three electrical terminals and to an electrical contact electrically connected to a third of said three electrical contacts; and the spring pressure on said toggle increasing as said toggle is moved from said center-off, at rest position.

2. The switch of claim 1 in which the electrical terminals are screw terminals mounted in the wall of said insulating housing.

3. The switch of claim 1 in which the spring members provide about equal increasing spring bias on the toggle as the toggle is pivoted in either clockwise or counterclockwise direction from the centeroff position.

4. The switch of claim 1 in which excessive pivoting of the toggle is prevented by resilient bumpers mounted in the insulating housing to receive the outer surfaces of the toggle facing generally the base of the housing.

5. The switch of claim 1 in which the toggle pivots about trunions mounted in receiving recesses between the cover and body of the insulated housing.

* * * * *